US006076241A

United States Patent [19]

Borel

[11] Patent Number: 6,076,241

[45] **Date of Patent: *Jun. 20, 2000**

[54] GUIDE AND BLOCKING DEVICE FOR A BOOT, AND A BOOT INCORPORATING SUCH DEVICE

[75] Inventor: René Borel, Saint-Sylvestre, France

[73] Assignee: Salomon S.A., Metz-Tessy, France

[ * ] Notice: This patent is subject to a terminal disclaimer.

[21] Appl. No.: 09/343,717

[22] Filed: Jun. 30, 1999

Related U.S. Application Data

[63] Continuation of application No. 08/980,298, Nov. 28, 1997, Pat. No. 5,956,823.

[30] Foreign Application Priority Data

Dec. 17, 1996 [FR] France ..... 96 15817

[51] Int. Cl.[7] ..... A43C 7/00

[52] U.S. Cl. ..... 24/712.9; 24/130

[58] Field of Search ..... 24/712.9, 130, 24/713.2; 36/50.1

[56] References Cited

U.S. PATENT DOCUMENTS

| | | | |
|---|---|---|---|
| 3,296,669 | 1/1967 | Elder, Jr. | 24/121 |
| 4,120,077 | 10/1978 | Fink | 24/130 |
| 4,290,173 | 9/1981 | Herlau | 24/118 |
| 4,787,660 | 11/1988 | Mrazek | 294/1.1 |
| 5,158,428 | 10/1992 | Gessner et al. | 24/712.9 |
| 5,467,511 | 11/1995 | Kubo | 24/712.1 |
| 5,522,120 | 6/1996 | Brinning | 24/130 |

FOREIGN PATENT DOCUMENTS

WO96/24269 8/1996 WIPO .

*Primary Examiner*—James R. Brittain
*Attorney, Agent, or Firm*—Greenblum & Berstein, P.L.C.

[57] ABSTRACT

Guide/blocking device for a lace of a boot, and a boot incorporating same. The guide/blocking device includes a sliding part defining a passageway for a lace oriented along a direction corresponding substantially to the direction of traction of the lace. The guide/blocking device includes a blocking part arranged in continuity with the sliding part and oriented in a direction substantially perpendicular to the direction of traction and corresponding to the blocking direction. Advantageously, the median plane of the sliding part and the blocking part is substantially co-planar with the plane of lacing, and the blocking section includes teeth that are inclined along a direction that is substantially perpendicular to the blocking direction.

40 Claims, 3 Drawing Sheets

GUIDE AND BLOCKING DEVICE FOR A BOOT, AND A BOOT INCORPORATING SUCH DEVICE

CROSS-REFERENCE TO RELATED APPLICATIONS

This application is a continuation of application Ser. No. 08/980,298, filed on Nov. 28, 1997, now U.S. Pat. No. 5,956,823 the disclosure of which is hereby incorporated by reference thereto in its entirety and the priority of which is claimed under 35 USC 120.

This application is also based upon French application No. 96.15817, filed on Dec. 17, 1996, the disclosure of which is hereby incorporated by reference thereto in its entirety and priority of which is hereby claimed under 35 USC 119.

BACKGROUND OF THE INVENTION

1. Field of the Invention

The invention is related to a guide/blocking element or device for a lace or similar device, especially intended for lacing a boot. The invention also is related to a boot incorporating such device.

2. Description of Background and Relevant Information

Traditionally, a boot is constituted of a sole and an upper equipped with an opening for the passage of the foot and comprising, on either side of such opening, a collection of guides for one or several laces intended to allow such opening to be closed when a traction is exerted thereupon.

These guides are generally constituted of hooks, but these books cannot retain the lace when it is loosened, or buckles through which the laces pass, the laces passing alternately above and below the plane of each buckle.

A major problem that is posed by all these known guide systems consists of the substantial friction that is produced between the lace and its guide, such that simple traction on the free ends of the lace is not enough to obtain an efficient tightening throughout the entire length of the lacing and one has to exert traction on each end of the lace comprised between two guides in order to obtain an efficient and homogeneous tightening along the entire lacing zone, including at the top of the foot.

This problem is especially critical for boots made of a relatively rigid material, for example, mountain climbing boots made of thick leather or skating boots, having a relatively rigid plastic shell, and for which an efficient tightening is desirable all the way through to the top of the foot.

As a matter of fact, this friction problem is heightened yet further by the length of the lacing zone that is necessary in order to reach the top of the foot.

Moreover, the friction or inadequate sliding of the lace is necessary to a certain extent because the braking effect that results therefrom also acts as an anti-return, facilitating the tightening, especially during the formation of the final bow or knot.

In order to overcome this disadvantage, one has been known to use lace blocking or pinching elements, that are separate from the guides and that are fixed along the edge of the upper, or slidably mounted on the lace. In the latter case, they are cumbersome and not necessarily easy to manipulate since they are mobile.

The document WO 96/24269 discloses a guide/blocking element for a lace constituted of a ring that is mobile with respect to a body, which allows a lace to slide, or inversely, acts as a blocking element for the lace, depending on the position that it occupies with respect to the body.

Such a guide/blocking element certainly has advantages, but it also has disadvantages, especially those stemming from the high costs of a multiple element and multiple material structure. Furthermore, the efficiency of such a system in its guide function mode is not optimum, because the lace passes alternately along either side of the lacing plane, thus resulting in parasitic friction.

In addition, the efficiency of such a blocking system depends enormously on the diameter of the lace to be blocked between the body and its mobile ring.

SUMMARY OF THE INVENTION

It is an object of the invention to overcome the above-cited disadvantages and to set forth an improved guide/blocking assembly, whose costs and volume requirements are minimal, and that allows one to reach a compromise between the two opposing requirements of improving the tightening efficiency and providing a blocking function at the end of the tightening process.

Another object of the invention is that the guide/blocking device is ergonomical and easy to use.

This object is achieved in the device according to the invention by the fact that it comprises a sliding portion defining a passageway for a lace oriented along a direction that corresponds substantially to the direction of traction on the lace, and a blocking portion arranged in continuity with the sliding section and oriented along a substantially perpendicular direction with respect to the direction of the traction and corresponding to the blocking direction.

The fact that the blocking portion is continuous with the sliding portion allows one to obtain an immediate blocking effect at the end of the actual tightening operation—i.e., the operation where a traction force is exerted on the ends of the lace—as soon as one brings the laces back transversely with respect to the direction of traction in order to make the knot.

According to a preferred embodiment, the sliding portion and the blocking portion are substantially co-planar, and the median plane of the sliding portion and the blocking portion is substantially co-planar with respect to the lacing plane. As a result, an optimum tightening efficiency is guaranteed because the lace always remains substantially in the same lacing plane, and because the friction is thus reduced to a minimum.

BRIEF DESCRIPTION OF THE DRAWINGS

The invention will be better understood and other characteristics thereof will become more apparent with the help of the following description, provided with reference to the annexed drawings illustrating non-restrictive examples of some preferred embodiments wherein.

DETAILED DESCRIPTION OF THE INVENTION

Figure 1:
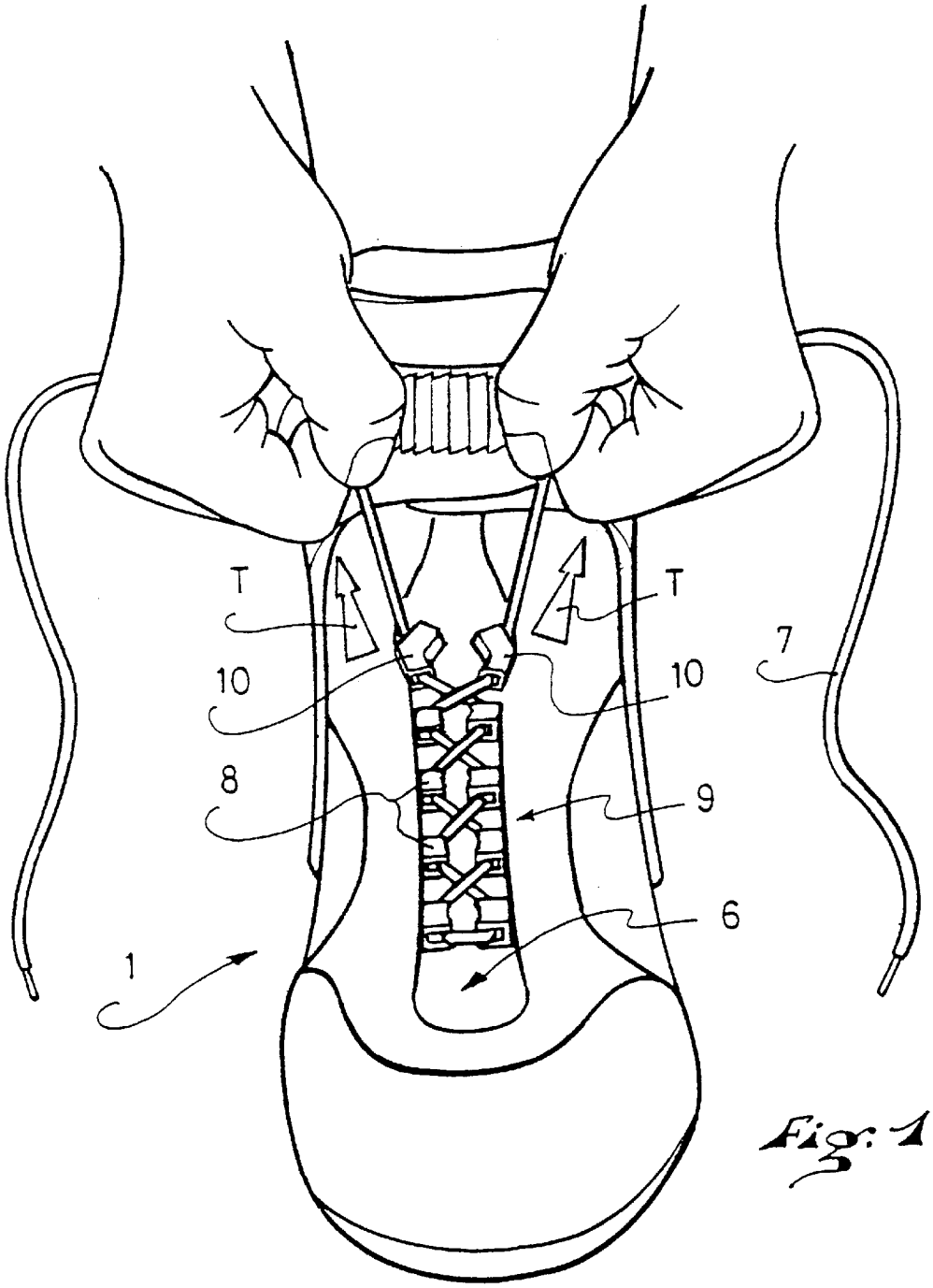
FIG. 1 is a top view of a boot illustrating the functioning of the guide during the traction operation on the lace.
Figure 2:
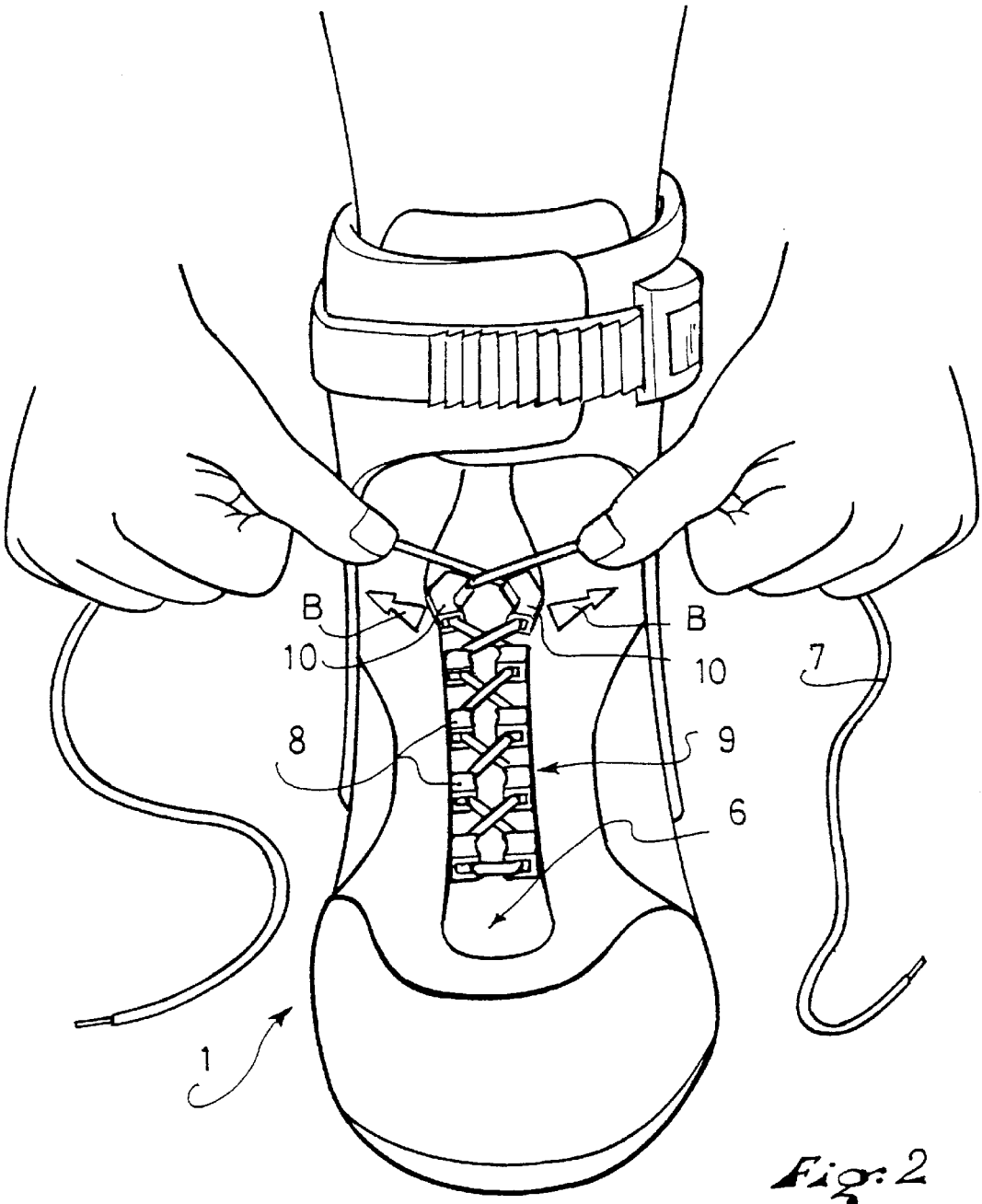
FIG. 2 is a view similar to FIG. 1 illustrating the functioning of the guide during the blocking operation of the lace.

FIGS. 1 and 2 illustrate the functioning of a guide/blocking device or element 10 according to the invention, located at the upper end of a lacing zone 9 of a boot 1, the lacing zone 9 comprising a plurality of guide elements or guides 8 located along either side of a boot opening 6, and through which a lace 7 passes.

Figure 3:
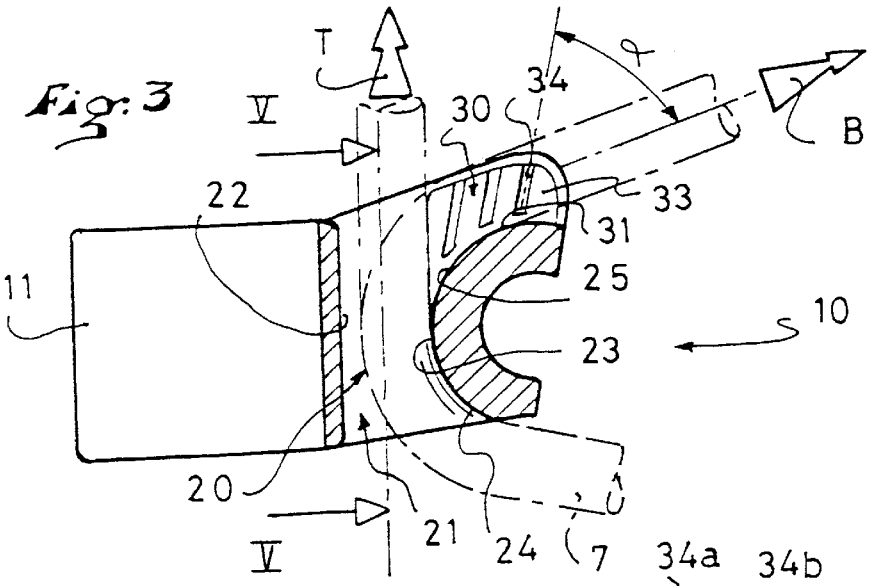
FIG. 3 is a sectional view taken along line III—III of FIG. 4.
Figure 4:
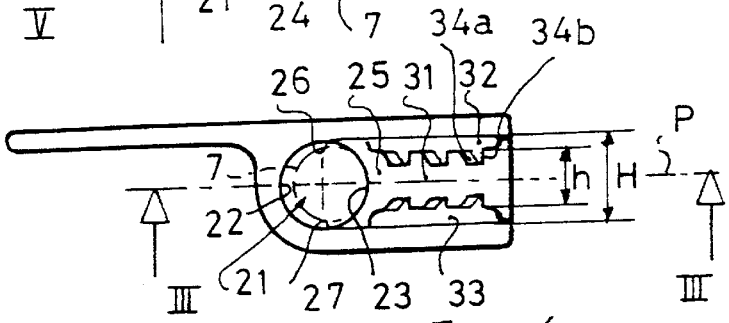
FIG. 4 is a side view of a guide/blocking element according to a first embodiment.
Figure 5:
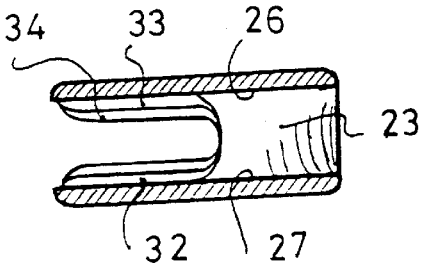
FIG. 5 is a sectional view taken along line V—V of FIG. 3.

As can be seen especially from FIGS. 3 through 5, the guide/blocking element 10 is constituted first of a tab 11 affixed to the boot, thus enabling the connection to be established either by a stitch or by a rivet. Any other affixing means to the boot can also be envisioned.

The functional portion of the guide/blocking element 10 is constituted essentially of two parts, or in other words, a first sliding part 20 and a second blocking part 30.

The sliding part 20 is essentially constituted by an essentially cylindrical housing whose diameter is slightly greater than that of the lace that must pass through the device 10, and which defines for the lace, a passageway 21 oriented along a direction "T" corresponding to the direction of traction of the lace (see arrows "T" on FIGS. 1 and 3), and oriented substantially parallel to the general direction of the lacing zone 9.

This passageway 21 is defined laterally by an outer wall 22, that is substantially curvilinear in the transverse direction, but extends substantially parallel to the direction of the traction "T" in the longitudinal direction, and by an inner wall 23, i.e., located on the side of the lacing zone, and having a substantially curvilinear shape in the longitudinal direction and comprising two entry and exit radii, respectively 24, 25. It is also defined on top and at the bottom by two rounded walls, respectively 26, 27.

The passageway 21 thus defined enables, due to its rounded parts and its general orientation, an optimum sliding of the lace. In addition, this passageway 21 defines a trajectory for the lace, whose median plane is always located in the same plane "P", which is the lacing plane, without having to pass from one side to the other of the plane. This results in an even greater improvement in the sliding of the lace, and thus an optimum tightening efficiency, due to the fact that the undesirable frictional forces are eliminated, the latter occurring due to the passage of the lace from one side to the other of the lacing plane, which is typical of traditional guide systems.

The blocking part 30 is located in the extension of the sliding part 20, i.e., the blocking part 30 extends from the sliding part 20, in the area of the exit end of the sliding part 20, and its median plane becomes intermingled with the median plane "P" of the sliding part, and is oriented along a direction "B", substantially perpendicular (or in other words, forming an angle comprised substantially between 45° and 90°) to the direction of traction "T" and corresponding to the blocking direction. Thus, the blocking part 30 includes a second passageway that extends from the first passageway 21 of the sliding part 20.

This blocking part 30 is defined, on the side of the lacing zone, by a cylindrical wall 31 appearing in the extension of the wall 25 of the sliding part 20, and at the top and the bottom, by two substantially horizontal walls, respectively 32, 33.

Part 30 is not closed on the opposite side of the lacing zone, so as to allow the lace 7 to be turned down, from its sliding position represented in dotted and dashed lines along the direction "T" in FIG. 3.

The two walls 32 and 33 are set back with respect to the adjacent walls 26, 27 of the sliding part 20, and thus demarcate a passage section, or second passageway, having a substantially reduced height "h" with respect to the height "H" of the passage section of path 21 (see FIG. 4). As shown, these heights are transverse dimensions of the respective passageways.

This reduction in the passage height enables one to obtain a first blocking effect on lace 7.

Preferably, the ratio "h/H" is comprised between 0.3 and 1.

In order to improve this blocking effect, the walls 32, 33 are also equipped with teeth 34.

These teeth are preferably inclined, along an angle "a" of approximately 45° with respect to the blocking direction "B" indicated in FIG. 3.

These teeth could also be straight and, for example, be parallel to the direction of the wall 22.

Each tooth 34 comprises, along the blocking direction "B", a first part 34*a* in the form of a rising ramp, and a relatively straight second part 34*b*, so as to facilitate, by the ramp effect, the blocking of the lace, and to retain, by the wall effect of their straight portion 34*b*, the lace in the blocking position.

Figure 6:
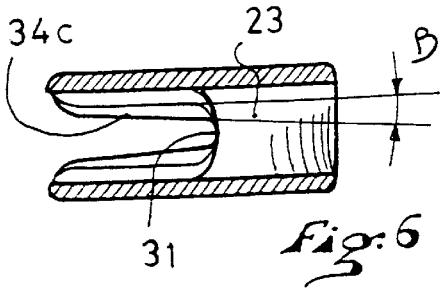
FIG. 6 is a view of a guide/blocking element similar to FIG. 5 according to a second embodiment.

According to another embodiment represented in FIG. 6, for which the same elements have been designated with identical references, each tooth 34 also comprises a section 34*c* in the shape of a ramp, that is hollowed from the base 31 of the blocking part 30 up to the free ends thereof, by forming, with the wall 32, 33, an angle "β" comprised between approximately 0 and 15°, and preferably approximately 6°, so as to provide an additional blocking effect.

The guide/blocking element 10 as per the invention is extremely simple and easy to use.

In fact, its sliding part enables the desired tightening tension force to be applied extremely easily by simple traction along direction "T" on each end of the lace 7 (see FIG. 1).

Once the desired tightening tension is obtained, the ends of the lace need only be turned down towards the inside along the direction "B", which corresponds exactly to the movement necessary to start to make the knot, in order to block the ends of the lace 7 in part 30 of the guide/blocking element and thus prevent any accidental loosening. The knot can thereafter be completed without there being any risk of accidental loosening, and thus loss of tension of the lace.

In addition, even in this position (lace blocked in the notches 34), one can readjust the tightening tension by exerting simple traction on the lace because this lace becomes automatically undone due to the ramps 34*a* and the angle "a" of the teeth 34.

Moreover, obtaining a knot becomes substantially easier because it can be made on ends that have been freed from all tension, due to the blocking effect obtained.

It ought to be noted that this guide/blocking element is especially simple and easy to use because the movements necessary for the traction or the blocking effect correspond exactly to movements that are made naturally.

Specifically, blocking does not require having to turn down the lace into a lower plane, as was the case with the guide/blocking element of the document WO 96/24269, and is therefore much more practical to use.

One should also note the simplicity of the loosening, which is also obtained by the natural separation effect of the laces.

Finally, such a guide/blocking device can be obtained very easily because it does not comprise any mobile element, it is made all in one piece by molding an appropriate plastic material, and is thus inexpensive to manufacture.

What is claimed is:

1. A guide/blocking device for a lace of a boot, said device comprising:

a guiding part defining a first passageway for slidably receiving the lace therethrough, said first passageway comprising a lace entry and being generally oriented along a traction direction corresponding substantially to a direction of a traction force to be exerted on the lace for tightening the lace;

a blocking part defining a second passageway, said second passageway extending from said first passageway, being arranged subsequently with respect to said first passageway and comprising a lace exit, said second passageway being generally oriented along a blocking direction for holding the lace in a blocked position.

2. A guide/blocking device according to claim 1, wherein:

said blocking direction is substantially perpendicular to said traction direction.

3. A guide/blocking device according to claim 1, wherein:

said blocking direction and said traction direction form an angle of substantially between 45° and 90°.

4. A guide/blocking device according to claim 1, wherein:

said guiding part and said blocking part extend substantially along a common plane.

5. A guide/blocking device according to claim 1, wherein:

said guiding part is demarcated in said traction direction by a substantially rectilinear wall and a curvilinear wall.

6. A guide/blocking device according to claim 1, wherein:

said blocking part comprises teeth inclined substantially perpendicularly to said blocking direction.

7. A guide/blocking device according to claim 6, wherein:

said blocking part includes a passageway having a transverse dimension that is less than a corresponding transverse dimension of said passageway of said guiding part.

8. A guide/blocking device according to claim 6, wherein:

said blocking part includes a passageway;

said teeth are positioned on opposite sides of said passageway of said blocking part and converge at an angle between approximately 0° and 15° to wedge the lace between opposed ones of said teeth in said blocking position.

9. A guide/blocking device according to claim 1, wherein:

said blocking part includes a passageway having a transverse dimension that is less than a corresponding transverse dimension of said passageway of said guiding part.

10. A guide/blocking device according to claim 1, wherein:

said blocking part comprises teeth, each of said teeth extending in a direction inclined approximately 45° to said blocking direction.

11. A guide/blocking device for a lace of a boot, said device comprising:

a guiding part defining a passageway for slidably receiving the lace therethrough, said passageway oriented along a traction direction corresponding substantially to a direction of a traction force to be exerted on the lace for tightening the lace;

a blocking part arranged along a blocking direction for holding the lace in a blocked position;

said guiding part comprising an inner guiding surface for guiding the lace in said traction direction;

said blocking part comprising an inner blocking surface for blocking the lace in said blocking direction;

said inner blocking surface of said blocking part extending from said inner guiding surface of said guiding part.

12. A guide/blocking device for a lace of a boot, said device comprising:

a guiding part defining a first passageway for slidably receiving the lace therethrough, said first passageway comprised of at least one surface oriented along a traction direction corresponding substantially to a direction of a traction force to be exerted on the lace for tightening the lace;

a blocking part defining a second passageway, said second passageway comprised of at least one surface extending from said at least one surface of said first passageway of said guiding part, said second passageway of said blocking part oriented along a blocking direction for holding the lace in a blocked position.

13. A guide/blocking device according to claim 12, wherein:

said blocking direction is substantially perpendicular to said traction direction.

14. A guide/blocking device according to claim 12, wherein:

said blocking direction and said traction direction form an angle of substantially between 45° and 90°.

15. A guide/blocking device according to claim 12, wherein:

said guiding part and said blocking part extend substantially along a common plane.

16. A guide/blocking device according to claim 12, wherein:

said guiding part is demarcated in said traction direction by a substantially rectilinear wall and a curvilinear wall.

17. A guide/blocking device according to claim 12, wherein:

said blocking part comprises teeth inclined substantially perpendicularly to said blocking direction.

18. A guide/blocking device according to claim 17, wherein:

said blocking part includes a passageway having a transverse dimension that is less than a corresponding transverse dimension of said passageway of said guiding part.

19. A guide/blocking device according to claim 17, wherein:

said blocking part includes a passageway;

said teeth are positioned on opposite sides of said passageway of said blocking part and converge at an angle between approximately 0° and 15° to wedge the lace between opposed ones of said teeth in said blocking position.

20. A guide/blocking device according to claim 12, wherein:

said blocking part includes a passageway having a transverse dimension that is less than a corresponding transverse dimension of said passageway of said guiding part.

21. A guide/blocking device according to claim 12, wherein:

said blocking part comprises teeth, each of said teeth extending in a direction inclined approximately 45° to said blocking direction.

22. A boot comprising:

an opening;

a plurality of guide elements located along said opening, said plurality of guide elements defining a lacing zone;

a lace arranged to pass through said plurality of guide elements;

at least one guide/blocking device comprising:

a guiding part defining a first passageway for slidably receiving the lace therethrough, said first passageway comprised of at least one surface oriented along a traction direction corresponding substantially to a direction of a traction force to be exerted on the lace for tightening the lace;

a blocking part defining a second passageway, said second passageway comprised of at least one surface extending from said at least one surface of said first passageway of said guiding part, said second passageway of said blocking part oriented along a blocking direction for holding the lace in a blocked position.

23. A boot according to claim 22, wherein:

said lacing zone includes a lower end and an upper end; and said guide/blocking device is located at said upper end of said lacing zone.

24. A boot according to claim 22, wherein:

said blocking direction is substantially perpendicular to said traction direction.

25. A boot according to claim 22, wherein:

said blocking direction and said traction direction form an angle of substantially between 45° and 90°.

26. A boot according to claim 22, wherein:

said guiding part and said blocking part extend substantially along a common plane.

27. A boot according to claim 26, wherein:

said common plane is a common median plane of said guiding part and of said blocking part;

said lace passing through said plurality of guide elements define a lacing plane; and said median plane and said lacing plane are substantially co-planar.

28. A boot according to claim 22, wherein:

said guiding part is demarcated in said traction direction by a substantially rectilinear wall and a curvilinear wall.

29. A boot according to claim 22, wherein:

said blocking part comprises teeth inclined substantially perpendicularly to said blocking direction.

30. A boot according to claim 29, wherein:

said blocking part includes a passageway having a transverse dimension that is less than a corresponding transverse dimension of said passageway of said guiding part.

31. A boot according to claim 29, wherein:

said blocking part includes a passageway;

said teeth are positioned on opposite sides of said passageway of said blocking part and converge at an angle between approximately 0° and 15° to wedge the lace between opposed ones of said teeth in said blocking position.

32. A boot according to claim 22, wherein:

said blocking part includes a passageway having a transverse dimension that is less than a corresponding transverse dimension of said passageway of said guiding part.

33. A boot according to claim 22, wherein:

said blocking part comprises teeth, each of said teeth extending in a direction inclined approximately 45° to said blocking direction.

34. A boot according to claim 22, wherein:

said guiding part comprise an inner guiding surface for guiding the lace in said traction direction;

said blocking part comprises an inner blocking surface for blocking the lace in said blocking direction;

said inner guiding surface of said guiding part and said inner blocking surface of said blocking part merging to form a continuous surface.

35. A boot comprising:

a longitudinally extending opening;

a first plurality of guide elements positioned along a first side of said longitudinally extending opening and a second plurality of guide elements positioned along a second side of said longitudinally extending opening, said first and second pluralities of guide elements defining a lacing zone, said lacing zone including an upper end and a lower end;

a lace passing through said first and second pluralities of guide elements;

a first guide/blocking device positioned along said first side of said longitudinally extending opening and a second guide/blocking device positioned along said second side of said longitudinally extending opening, each of said guide/blocking devices comprising:

a guiding part defining a first passageway for slidably receiving the lace therethrough, said first passageway comprised of at least one surface oriented along a traction direction corresponding substantially to a direction of a traction force to be exerted on the lace for tightening the lace;

a blocking part defining a second passageway, said second passageway comprised of at least one surface extending from said at least one surface of said first passageway of said guiding part, said second passageway of said blocking part oriented along a blocking direction for holding the lace in a blocked position.

36. A boot according to claim 35, wherein:

said first guide/blocking device is positioned at said upper end of said lacing zone along said first side of said longitudinally extending opening and said second guide/blocking device is positioned at said upper end of said lacing zone along said second side of said longitudinally extending opening.

37. A boot according to claim 35, wherein:

for each said guide/blocking device, said blocking direction is substantially perpendicular to said traction direction.

38. A boot according to claim 35, wherein:

for each said guide/blocking device, said blocking direction and said traction direction form an angle of substantially between 45° and 90°.

39. A boot comprising:

a longitudinally extending opening;

a plurality of guide elements located along said longitudinally extending opening from a front-to-rear direction, said plurality of guide elements defining a lacing zone;

a lace arranged to pass through said plurality of guide elements;

at least one guide/blocking device rearward of at least certain ones of said plurality of guide elements, said guide/blocking device comprising:

a guiding part defining a first passageway for slidably receiving the lace therethrough, said first passageway oriented along a traction direction corresponding substantially to a direction of a traction force to be exerted on the lace for tightening the lace;

a blocking part defining a second passageway, said second passageway being arranged subsequently with respect to said first passageway of said guiding part, said second passageway of said blocking part being oriented along a blocking direction generally toward said longitudinally extending opening for holding the lace in a blocked direction.

40. A boot according to claim 39, wherein:

said at least one guide/blocking device comprising at least two guide/blocking devices, a first of said two guide/blocking devices located on a first lateral side of said longitudinally extending opening and a second of said two guide/blocking devices located on a second lateral side of said longitudinally extending opening;

said second passageway of said blocking part of each of said two guide/blocking devices being arranged subsequently with respect to said first passageway, each of said second passageway of each of said two guide/blocking devices being generally oriented along a blocking direction generally toward said opening for holding the lace in a blocked position.

* * * * *